US005896147A

United States Patent [19]

Mori et al.

[11] Patent Number: 5,896,147

[45] Date of Patent: Apr. 20, 1999

[54] LIQUID JET HEAD AND SUBSTRATE THEREFOR HAVING SELECTED SPACING BETWEEN EJECTION ENERGY GENERATING ELEMENTS

[75] Inventors: Toshihiro Mori; Masami Ikeda, both of Yokohama; Masami Kasamoto, Ayase; Yoshiyuki Imanaka; Teruo Ozaki, both of Yokohama; Masaaki Izumida, Kawasaki, all of Japan

[73] Assignee: Canon Kabushiki Kaisha, Tokyo, Japan

[21] Appl. No.: 08/546,962

[22] Filed: Oct. 23, 1995

[30] Foreign Application Priority Data

Oct. 21, 1994 [JP] Japan ..... 6-256716

[51] Int. Cl.[6] ..... B41J 2/05

[52] U.S. Cl. ..... 347/61

[58] Field of Search ..... 347/62, 63, 64, 347/61

[56] References Cited

U.S. PATENT DOCUMENTS

| | | | |
|---|---|---|---|
| 4,536,250 | 8/1985 | Ikeda et al. | 346/140 R X |
| 4,567,493 | 1/1986 | Ikeda et al. | 346/140 R |
| 4,602,261 | 7/1986 | Matsuda et al. | 346/140 R |
| 4,631,555 | 12/1986 | Ikeda et al. | 346/140 R |
| 4,694,306 | 9/1987 | Ikeda et al. | 346/140 R |
| 4,719,478 | 1/1988 | Tachihara et al. | 346/140 R |
| 4,720,716 | 1/1988 | Ikeda et al. | 346/140 R |
| 4,725,859 | 2/1988 | Shibata et al. | 346/140 R |
| 4,889,587 | 12/1989 | Komuro . | |
| 5,160,403 | 11/1992 | Fisher et al. | 156/633 |
| 5,164,747 | 11/1992 | Osada et al. | 346/140 R |
| 5,182,577 | 1/1993 | Ishinaga et al. | 346/140 R |
| 5,218,754 | 6/1993 | Rangappan | 29/611 |
| 5,237,343 | 8/1993 | Osada | 346/140 R |
| 5,410,340 | 4/1995 | Drake et al. | 347/62 |

FOREIGN PATENT DOCUMENTS 0376514 7/1990 European Pat. Off. .

*Primary Examiner*—Edward H. Tso

*Attorney, Agent, or Firm*—Fitzpatrick,Cella,Harper & Scinto

[57] ABSTRACT

A liquid jet element substrate having a plurality of ejection energy generating elements for generating ejection energy for ejecting liquid, arranged in an array in a direction at predetermined intervals, wherein an interval between the ejection energy generating element at an end, in the direction of the array, and the ejection energy generating element adjacent thereto is smaller than an interval between adjacent central ejection energy generating elements.

16 Claims, 6 Drawing Sheets

LIQUID JET HEAD AND SUBSTRATE THEREFOR HAVING SELECTED SPACING BETWEEN EJECTION ENERGY GENERATING ELEMENTS

FIELD OF THE INVENTION AND RELATED ART

The present invention relates to an element chip, which comprises an energy generating element for generating ejection energy to be used for ejecting recording liquid (ink or the like) in the form of a flying liquid droplet from an ejection outlet (orifice), and is employed in an ink jet head installed in an ink jet recording apparatus, which generates records by adhering the ejected liquid droplets to the recording medium. In particular, the present invention relates to such an element chip in which plural energy generating elements for generating the ink ejection energy to be used for ejecting the ink are arranged in a predetermined manner. The present invention also relates to an ink jet head, in which plural ejection energy generating elements are arranged in a predetermined manner, and an ink jet apparatus comprising such a head.

The ink jet recording method is a recording method in which ink (recording liquid) is ejected from an orifice, or orifices, of a recording head, so that the ejected ink is adhered to recording medium, such as paper, to create a record. This method has various advantages. For example, it generates only an extremely small amount of noise, and can record at a high speed. In addition, it can record on plain paper and it does not require dedicated paper with special composition. Therefore, various types of ink jet recording head have been developed.

Among them, there is a type which applies thermal energy to the ink to eject it from the orifice. This type of ink jet head is produced in the following manner. The electrothermal transducers and electrodes are formed on a substrate, and are covered with a protective film as needed. Then, a top plate, in which liquid paths and a liquid chamber are formed, is joined with the substrate.

The ejection energy for ejecting the ink from this type of recording head is generated by the electrothermal transducer comprising a pair of electrodes, and a heat generating resistor element disposed between the pair of electrodes. More specifically, an electric signal is applied to the electrode to cause the heat generating resistor element to generate heat. As heat is generated by the heat generating resistor, the ink adjacent to the heat generating resistor disposed within the ink path is instantaneously heated, generating bubbles. As the volume of each bubble quickly grows and contracts, the ink is ejected in the form of a liquid droplet.

When a recording head, which is structured as described in the foregoing, and is capable of accommodating an A3 paper, is wanted, plural element chips, in which a predetermined number of heat generating resistor elements are arranged at a predetermined pitch, are employed. More specifically, the plural element chips are precisely aligned on a supporting member, which has a width correspondent to the recording width, so that the recording width for A3 paper can be entirely covered with the aligned heat generating resistor elements, at the same pitch as the heat generating resistor element pitch in each of the element chips.

However, the structure described above suffers from the following shortcoming. That is, in order to make the heat generating resistor element pitch, between the heat generating resistor elements located at each end of two adjacent element chips, substantially equal to the predetermined element pitch in each chip, both ends of each element chip must be cut at a point extremely close to a heat generating resistor element, during the element chip production.

As a result, the portions of the element chip, or, in the worst case, the heat generating resistor element itself, is liable to be damaged by chipping and/or shell cracking that could occur during the cutting process.

SUMMARY OF THE INVENTION

According to the present invention, which was made to eliminate the shortcoming described above, the heat generating resistor elements located near the end, relative to the alignment direction, of each element chip, are aligned at a smaller pitch than the normal (main) pitch for the heat generating resistor elements located across the middle of the same element chip; that is, they are inwardly displaced, relative to the end of each element chip. With such placement of the heat generating resistor elements, the margin, which is reserved for cutting the substrate to separate each element chip, can be increased to prevent the heat generating resistor element from being damaged by chipping, shell cracking, and the like.

Further, when the above structure is not satisfactory, a stepped portion may be formed between the heat generating resistor element adjacent to the cutting margin, and the cutting margin, so that the effects of the aforementioned structure can be enhanced.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the embodiments of the present invention will be described with reference to the drawings.

The phrase, "on the substrate," which is used in the following embodiments, means "on the substrate," as well as "immediately below the plane of the substrate surface."

Even though ink is used as the liquid to be ejected in the following embodiments, the liquid to be ejected is not limited to ink; any liquid is usable as long as it can be ejected by the ejection head in accordance with the present invention.

Figure 1:
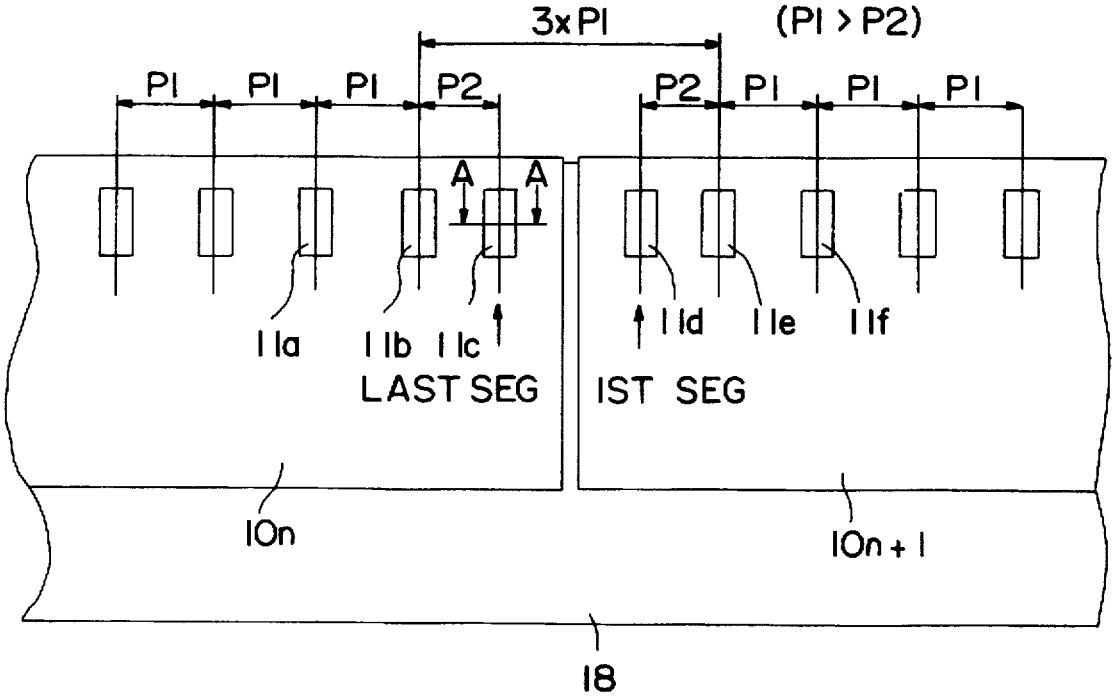
FIG. 1 is a schematic view of an embodiment of the present invention.

FIG. 1 is a schematic view of an embodiment of the present invention. A reference numeral 11 designates a heat generating resistor element (ejection heater) as an ejection energy generating member. Each ejection heater comprises a heat generating resistor layer 12, and a pair of electrodes (unillustrated); and generates heat as a voltage is applied to the heat generating resistor layer 12 through the pair of electrodes. One of the electrodes is connected to an independent electrode (unillustrated), and the other is connected to a common electrode (unillustrated).

The heat generating resistor elements 11 are aligned on the element substrate at a predetermined pitch P1, except that the first and last heat generating resistor elements of each element chip, that is, the heat generating resistor element located at each end, in the alignment direction, of each element chip, is aligned at a shorter pitch P2 than those segments located between the first and last elements. Further, counting from left to right in FIG. 1, the distance between the last element 11*c* of the first element chip, and the first element 11*d* of the next element chip is rendered greater than P1. Lastly, the distance between the second element 11*b*, counting from right to left, of the first element chip, and the second segment 11*e*, counting from left to right, of the next element chip, is set at a distance of approximately 3×P1. Therefore, plural element chips can be aligned in a straight line, so that the alignment pitch for the heat generating resistor elements can be rendered substantially uniform across the entire length of the alignment.

Figure 2:
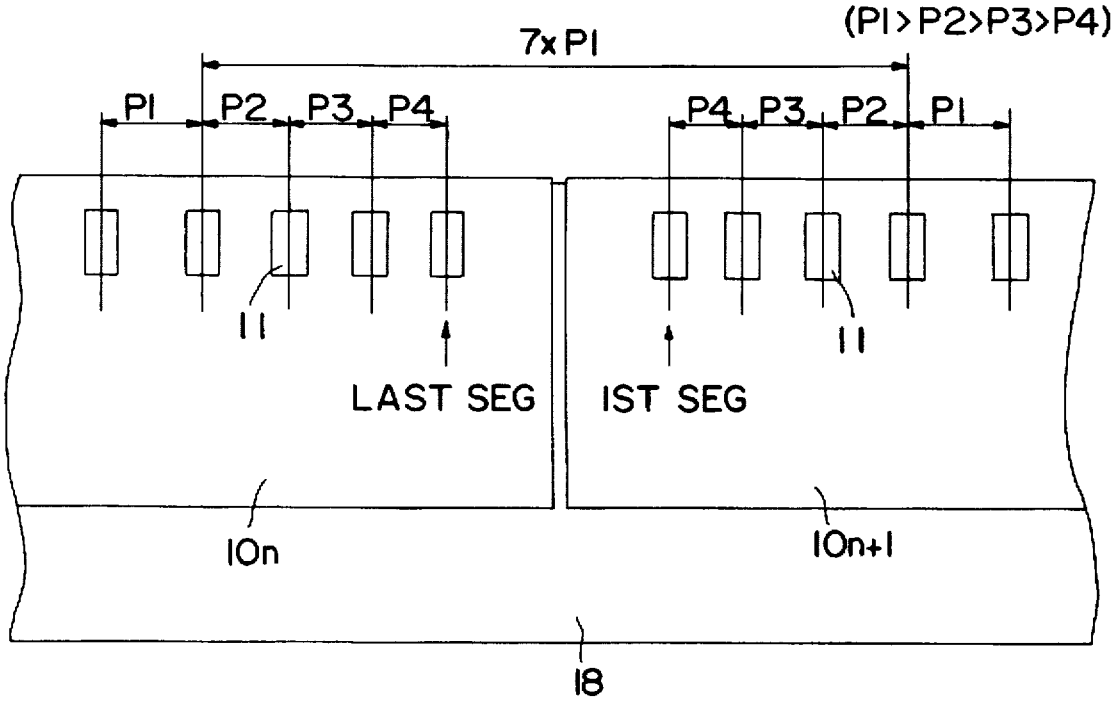
FIG. 2 is a schematic view of another embodiment of the present invention.

FIG. 2 is a schematic view of another embodiment of the present invention, in which three different pitches (P2, P3 and P4), which are shorter than the normal alignment pitch P1, are employed. In this drawing, the relationship among the different pitches is: P1>P2>P3>P4. However, the relationship among the different pitches is not limited to the above. In other words, such factors as the number of alignment pitches different from the regular pitch P1, the positional relationship among the different pitches, and the like, may be optionally combined to obtain the same effect as the present invention.

In the embodiment illustrated in FIG. 1, the distance between the second ejection heater, counting from left to right, of one element chip, and the second ejection heater, counting from right to left, of the next element chip, is set at approximately three times the pitch for the ejection heaters located at the center portion of the element chip. In the embodiment illustrated in FIG. 2, the distance between the third ejection heater, counting from left to right, of one element chip, and the third ejection heater, counting from right to left, of the next element chip, is set at approximately seven times the pitch for the ejection heaters located at the center portion of the element chip.

With the arrangements described above, the element chip can be cut at a point close to the ejection heater, without damaging it; therefore, even when plural element chips are continuously aligned in a straight line, the ejection heater intervals can be rendered generally uniform.

The ejection heater intervals are not limited to those described above. Needless to say, the distance between the second ejection heaters of two adjacent element chips, counting away from the joint, may be set at approximately five times the interval between the adjacent ejection heaters located at the central portion of each element chip.

In the preceding embodiment, the interval between the adjacent two ejection heaters located near each end of each element chip is adjusted. However, when only two element chips are aligned, the ejection heater interval may be adjusted only at the element chip end on the joint side.

Figure 3:
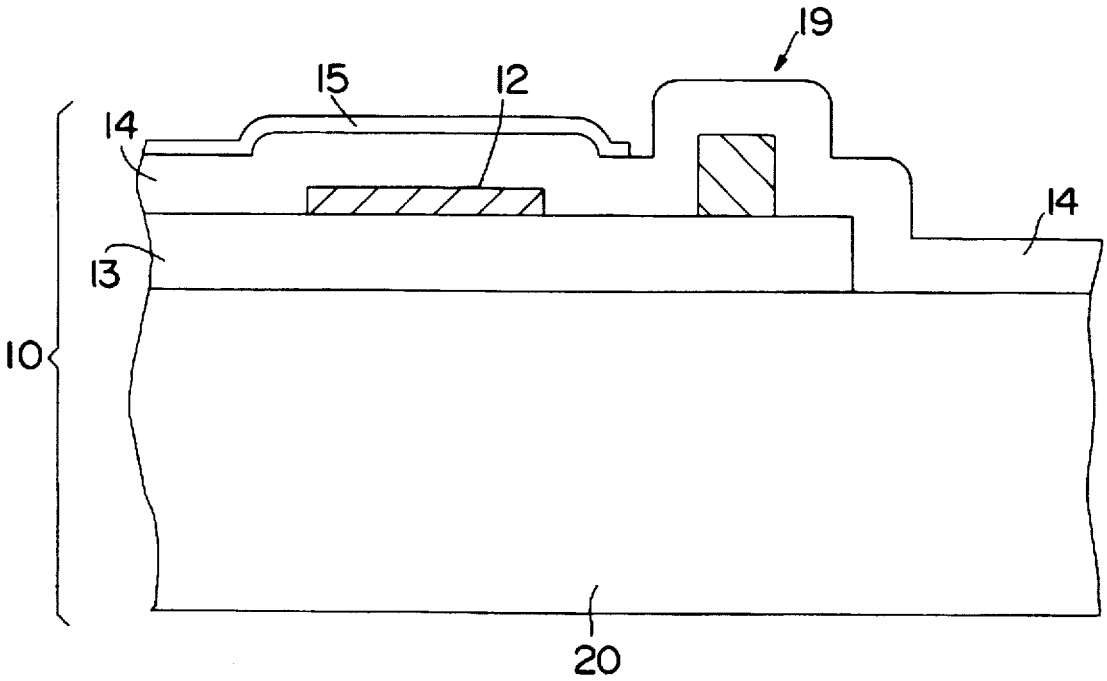
FIG. 3 is a schematic view of a further embodiment of the present invention.

FIG. 3 is a schematic section (at A—A line in FIG. 1) of the embodiment of the present invention, illustrating a stepped portion 19 for preventing the advance of the crack, such as pitching or shell crack, which occurs while the substrate is cut. The stepped portion 19 can be formed using, for example, the same manufacturing step and the same material (Al, Cu or the like) for wiring electrode, without increasing the number of manufacturing steps. If cost is not a concern, the stepped portion 19 may be formed of a separate material (organic material such as polyimede).

Figure 4:
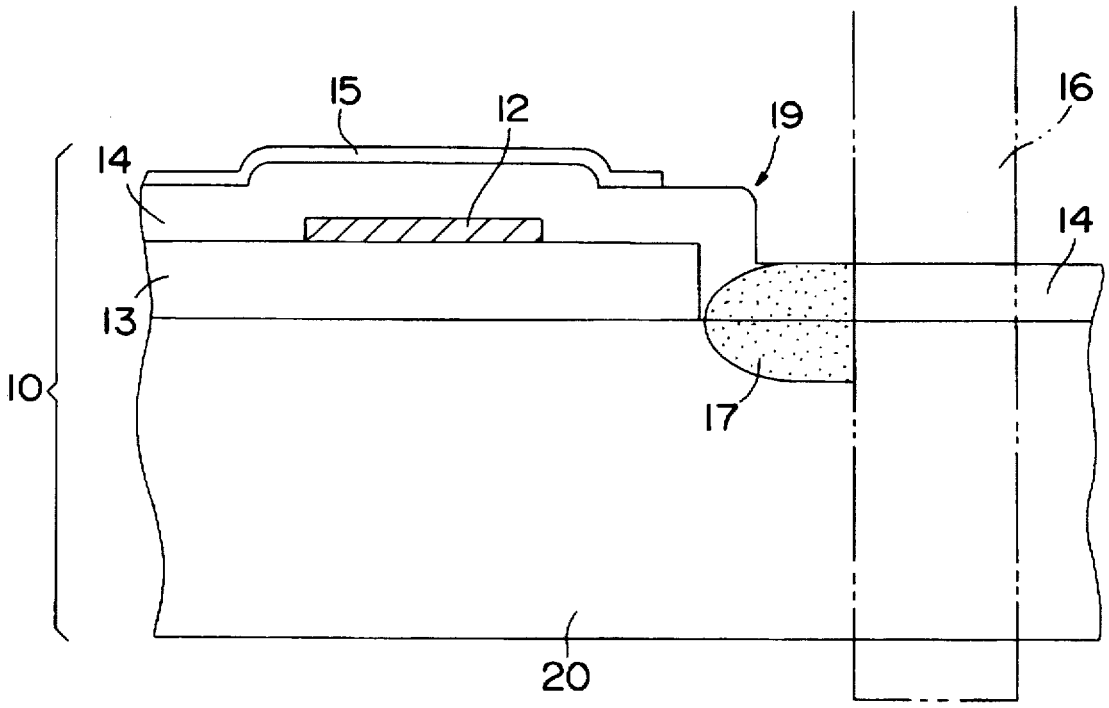
FIG. 4 is a schematic sectional view of the embodiment of the present invention, illustrating a state of chipping which occurs when a substrate structured according to the present invention is cut.

FIG. 4 is a schematic sectional view of the embodiment of the present invention, illustrating how the advance of the crack is prevented while the substrate is cut. Even if a crack 17 occurs as the chip substrate 10 is cut across a margin 16, the advance of the crack can be stopped at the stepped portion 19.

Figure 5:
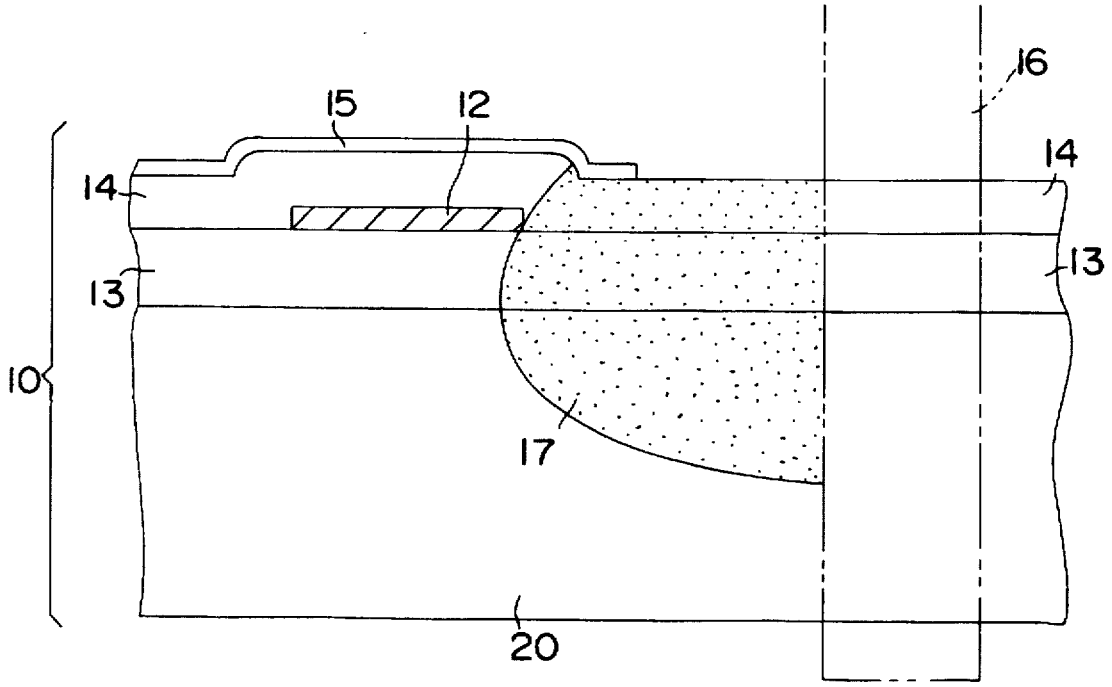
FIG. 5 PRIOR ART
FIG. 5 is a schematic view of a conventional element chip, illustrating a state of chipping which occurs when a conventionally structured element chip is cut.
Figure 6:
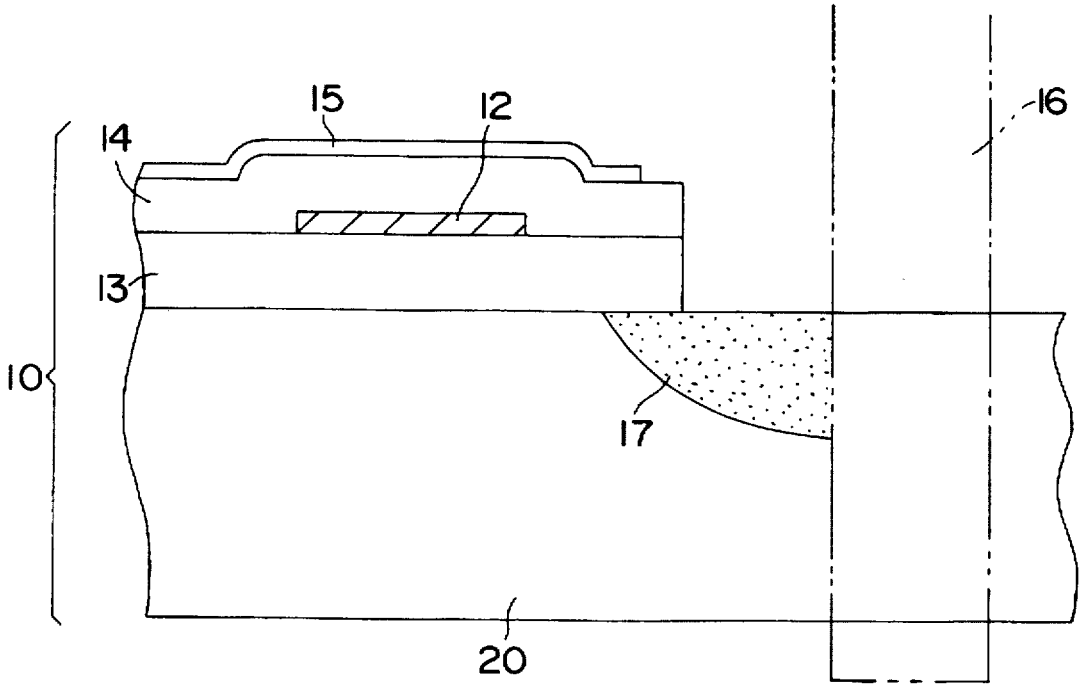
FIG.6 PRIOR ART
FIG. 6 is a schematic view of another state of chipping which occurs when the conventionally structured element chip is cut.

FIGS. 5 and 6 are schematic sections of the conventional chip structure, illustrating how the crack advances while the substrate is cut.

As is evident from FIGS. 5 and 6, when the stepped portion 19 for crack advance prevention illustrated in FIG. 4 is not provided, the crack spreads to affect the elements formed on the chip substrate.

The recording head described above can be produced following the steps described below.

To begin with, a 1–3 μm thick $SiO_2$ film as a heat storage layer 13 is formed on a Si wafer, using thermal oxidation. Next, a 400–2,000 Å thick $HfB_2$ film which becomes the heat generating resistor layer, a 10–100 Å thick Ti film which becomes an adhesion enhancement layer, and a 3,000–10,000 Å thick Al (wiring electrode material), are deposited in this order by sputtering. Then, the heat generating resistors, electrodes, and the like, of desired patterns are formed by photolithography.

Next, a 1–2 μm thick film of $SiO_2$ or $Si_3N_4$ as a protective layer 14 is formed by CVD or sputtering. Thereafter, a 2,000–5,000 Å thick Ta film as a cavitation resistance layer 15 is deposited by sputtering. Then, the desired patterns are formed by photolithography to complete the element chip 10.

The element chips 10 are precisely aligned on a supporting member 18 (for example, Al substrate) with excellent heat radiating properties, and fixed thereto by die bonding.

Lastly, a glass plate (unillustrated), which has grooves for forming at least the ink paths and orifices, is aligned on the chip substrate, so that the groove portions for forming the ink paths are properly located in relation to the heat generating portion formed on the chip substrate, and is glued thereto.

Instead, the walls for forming at least the ink paths and ejection orifices, may be formed on the chip substrate by photolithography which uses photosensitive resin or the like, and then, the walls may be covered to complete the recording head.

Figure 7:
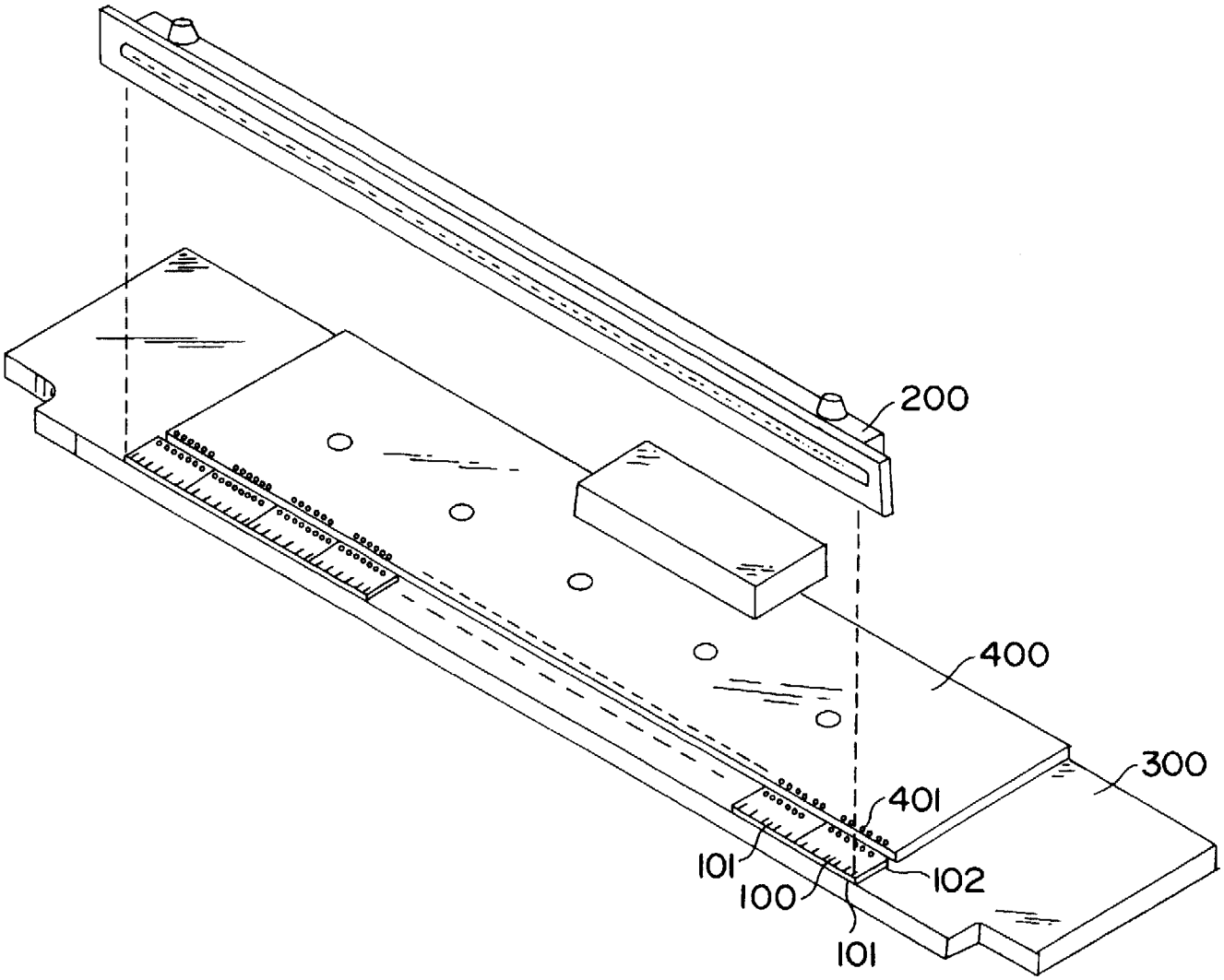
FIG. 7 is an exploded perspective view of an widened head, in which plural element chips in accordance with the present invention are aligned in a predetermined manner.

In the preceding embodiment, two element chips are aligned. However, a much larger number of element chips may be aligned to lengthen the recording head. FIG. 7 illustrates such an example, in which plural element chips 100, in which plural heat generating resistors 101 are aligned in a straight line, are aligned in a straight line on a supporting member (base plate) of aluminum (Al) or the like. Each element chip is connected to the contact pad of the wiring chip through a connector 102. The top plate 200, which is grooved to form an ink path for each heat generating resistor, is attached to the plural element chips aligned as described above, to complete a wider head.

Figure 8:
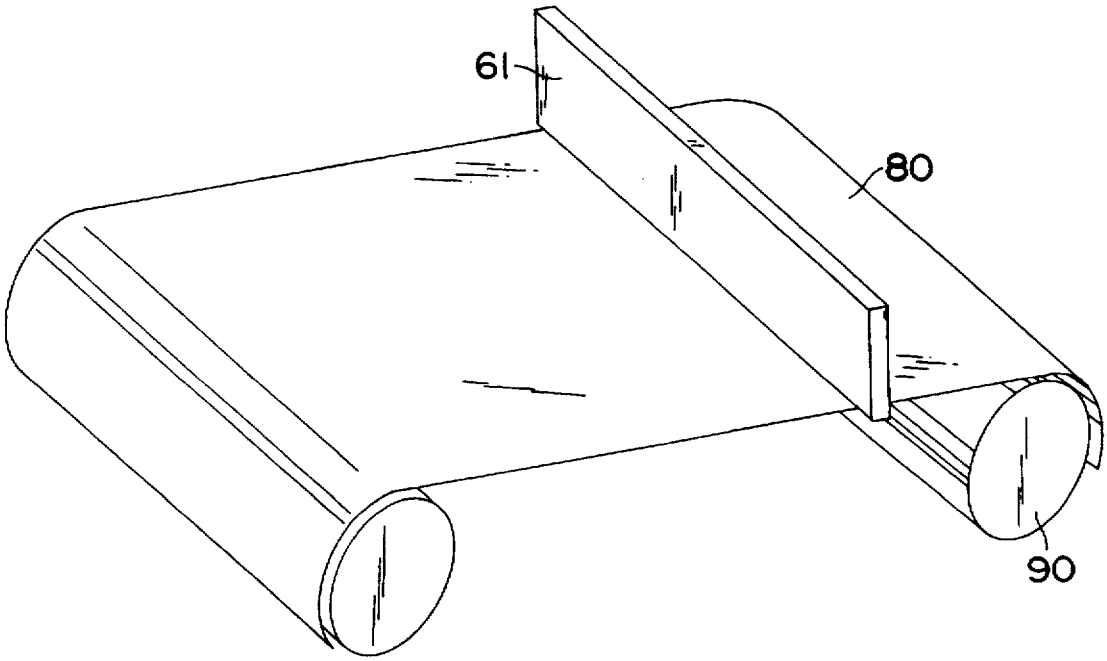
FIG. 8 is a conceptual view of an ink jet recording apparatus employing a full-line head in accordance with the present invention.

FIG. 8 is a schematic perspective view of a so-called full-line type recording head, the width of which corresponds to the recording width of the recording medium, and a recording apparatus, in which the full-line type recording head is mounted. The present invention displays the most outstanding effects when applied to the full-line recording head illustrated in FIG. 8.

Referring to FIG. 8, a reference numeral 6 designates a full-line recording head. The ink is ejected from this recording head, in response to signals supplied from driving signal supplying means (unillustrated), toward a recording medium 80 such as paper or fabric conveyed by a conveyer roller 90, whereby recording is made on the recording medium 80. According to the present invention, even when a widened extended recording head such as the full-line head is employed, high quality recording can be easily made.

Figure 9:
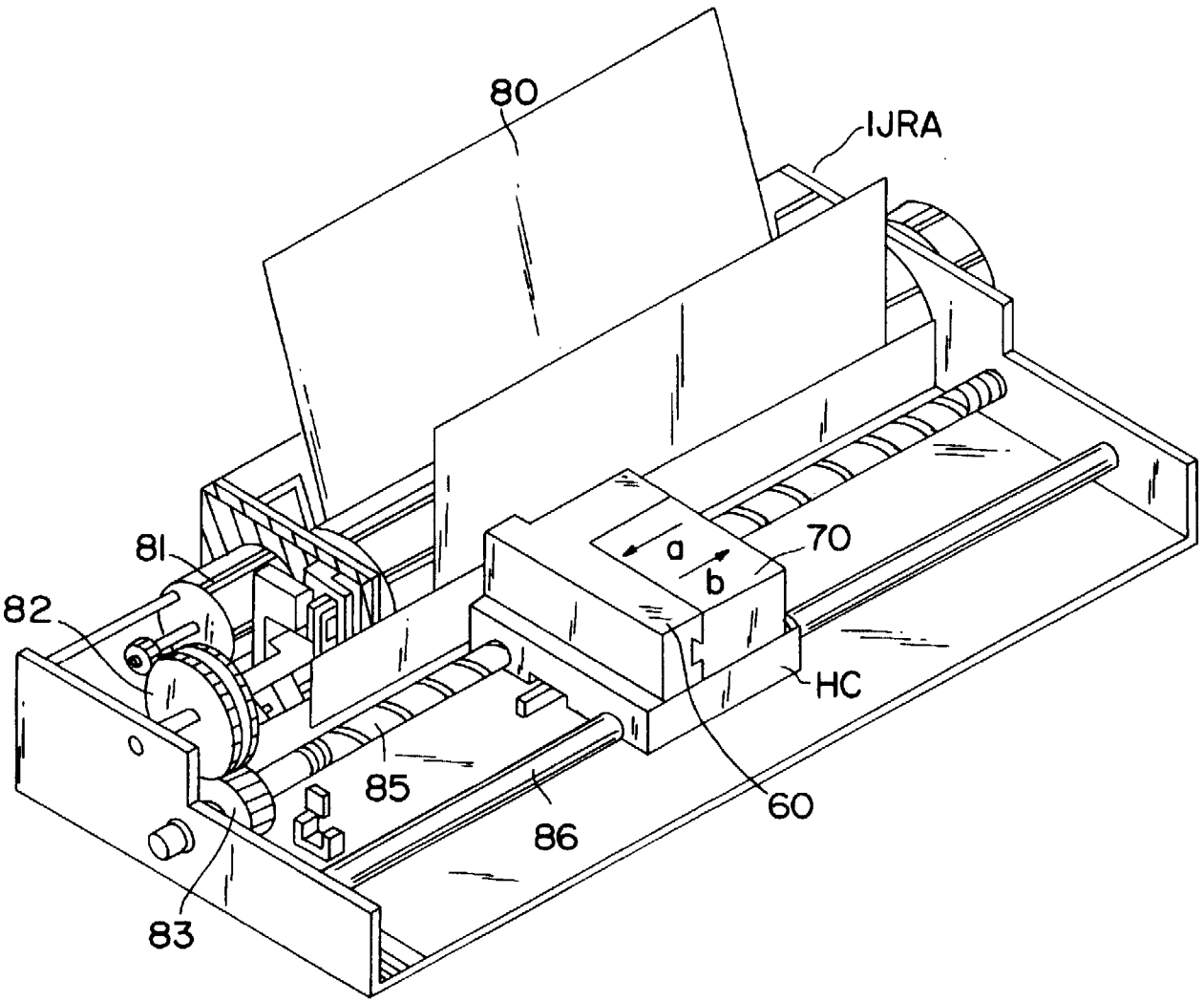
FIG. 9 is a perspective view of an ink jet recording apparatus employing the ink jet head in accordance with the present invention.

FIG. 9 shows such a recording apparatus that employs a small recording head comprising only one or two element chips. The recording apparatus illustrated in FIG. 9 comprises a recording head cartridge constituted of an independently exchangeable ink container 70 and an independently exchangeable recording head portion 60. It also is comprises: a motor 81 as a driving power source, which drives the carriage; a conveyer roller 90 for conveying a recording medium 80; and a carriage shaft 85 for transmitting the driving force from the driving power source to the carriage. Further, it comprises signal supplying means for supplying an ink ejection signal to the recording head.

As described above, according to the present invention, even in the case of manufacturing a small element chip which requires cutting the chip substrate at a point close to the region in which the heat generating resistors are disposed, no damage occurs to the heat generating resistor. Therefore, even when plural element chips are aligned in a straight line, the heat generating resistor pitch can be rendered substantially uniform across the entire length of the alignment, satisfying the condition for the heat generating resistor alignment.

As is evident from the foregoing, according to the present invention, even when plural element chips are employed, the ejection heater pitch can be rendered substantially uniform across the combined length of the plural chips.

Further, the present invention also enjoys an advantage in that the element chip in accordance with the present invention can be manufactured using the conventional process, without a need for increasing the number of manufacturing steps; therefore there is no cost increase.

Further, when the chip substrate is cut to yield element chips, it can be cut at a point close to the heat generating resistor; therefore, plural element chips can be aligned to produce a wider recording head.

Consequently, the wider recording head can be inexpensively produced with extremely high yield.

When the head described is employed, an ink jet apparatus capable of recording high quality images at a high speed can be inexpensively produced.

While the invention has been described with reference to the structures disclosed herein, it is not confined to the details set forth, and this application is intended to cover such modifications or changes as may come within the purposes of the improvements or the scope of the following claims.

What is claimed is:

1. A liquid ejection head comprising:

a plurality of ink ejection outlets;

a corresponding number of liquid flow paths in fluid communication with said ejection outlets, respectively;

a plurality of element substrates each having a plurality of ejection energy generating elements in an array, said ejection energy generating elements being provided for said liquid flow paths, respectively to produce ejection energy for ejecting liquid through said ejection outlets, wherein said ejection energy generating elements are arranged at substantially regular intervals except for an end of the array where at least one ejection energy generating element at the end is deviated inwardly of the array, and said plurality of substrates are so arranged that the intervals of the ejection energy generating elements are generally regular as a whole of said substrates.

2. A substrate according to claim 1, wherein the end is each of the opposite ends of the array.

3. A substrate according to claim 1, wherein said end is only one end of the opposite ends of the array.

4. A liquid jet head according to claim 1, wherein a plurality of said element substrates are continuously arranged on a support member, and wherein an interval between a second ejection energy generating element from the end of a first element substrate and a second ejection energy generating element from the end of the second energy generating element, is approx. 3 times an interval between central ejection energy generating elements.

5. A liquid jet head according to claim 1, wherein a plurality of said element substrates are continuously arranged on a support member, and wherein an interval between a third ejection energy generating element from the end of a first element substrate and a third ejection energy generating element from the end of the second energy generating element, is approx. 5 times an interval between central ejection energy generating elements.

6. A liquid jet head according to claim 1, 2 or 3, wherein the liquid ejection head is formed by coupling said element substrate with a member having grooves for constituting said plurality of liquid flow paths.

7. A liquid jet head according to claim 6, wherein the groove members an elongated member common to the plurality of element substrates.

8. A liquid jet head according to claim 1, wherein said ejection energy generating elements include heat generating resistors.

9. A liquid jet head according to claim 1, wherein ink is supplied to said liquid flow path.

10. A liquid ejecting device comprising:

the liquid ejection head as defined in claim 1:

means for transporting a recording material.

11. A liquid ejection head comprising:

a plurality of ink ejection outlets;

a corresponding number of liquid flow paths in fluid communication with said ejection outlets, respectively;

a plurality of element substrates each having a plurality of ejection energy generating elements in an array, said ejection energy generating elements being provided for said liquid flow paths, respectively to produce ejection energy for ejecting liquid through said ejection outlets, wherein said ejection energy generating elements are arranged at substantially regular intervals except for an end of the array where at least one ejection energy generating element at the end is deviated inwardly of the array; and wherein such one of said ejection energy generating elements disposed substantially at the regular intervals in a predetermined one of said substrates as is adjacent to the ejection energy generating element provided at the end and deviated inwardly of the array, and such one of said ejection energy generating elements disposed substantially at the regular intervals in a substrate adjacent to the predetermined one as is adjacent to the ejection energy generating element provided at the end and deviated inwardly of the array, are separated from each other by a distance which is substantially equal to the regular interval multiplied by an integer.

12. A liquid ejection head according to claim 11, wherein the integer is 3.

13. A liquid ejection head according to claim 11, wherein the integer is 5.

14. A liquid ejection head according to claim 11, wherein the liquid ejection head is formed by coupling said element substrate with a member having grooves for constituting said plurality of liquid flow paths.

15. A liquid ejection head according to claim 11, wherein said ejection energy generating elements include heat generating resistors.

16. A liquid ejection head according to claim 11, wherein ink is supplied to said liquid flow path.

* * * * *

UNITED STATES PATENT AND TRADEMARK OFFICE

CERTIFICATE OF CORRECTION

PATENT NO. : 5,896,147

DATED : April 20, 1999

INVENTOR(S) : TOSHIHIRO MORI ET AL.

It is certified that error appears in the above-identified patent and that said Letters Patent is hereby corrected as shown below:

COLUMN 4

Line 19, "polyimedi" should read --polyamide".

COLUMN 5

Line 32, "is" should be deleted.

COLUMN 6

Line 45, "claim 1, 2 or 3," should read --claims 1, 4 or 5,--;
Line 50, "members an" should read --member is--.

Signed and Sealed this

Twenty-first Day of December, 1999

*Attest:*

Q. TODD DICKINSON

*Attesting Officer*

*Acting Commissioner of Patents and Trademarks*